United States Patent [19]

Hensley, Jr. et al.

[11] 4,406,779

[45] Sep. 27, 1983

[54] MULTIPLE CATALYST SYSTEM FOR HYDRODENITROGENATION OF HIGH NITROGEN FEEDS

[75] Inventors: Albert L. Hensley, Jr., Munster, Ind.; A. Martin Tait, Naperville, Ill.; Jeffrey T. Miller, Naperville, Ill.; Thomas D. Nevitt, Naperville, Ill.

[73] Assignee: Standard Oil Company (Indiana), Chicago, Ill.

[21] Appl. No.: 320,868

[22] Filed: Nov. 13, 1981

[51] Int. Cl.[3] ..... C10G 45/04

[52] U.S. Cl. ..... 208/254 H

[58] Field of Search ..... 208/254 H, 210

[56] References Cited

U.S. PATENT DOCUMENTS

| | | | |
|---|---|---|---|
| 3,186,936 | 6/1965 | Wood et al. | 208/254 H |
| 3,269,938 | 8/1966 | Lefrancois | 208/254 H |
| 3,642,612 | 2/1972 | Girotti et al. | 208/89 |
| 4,153,540 | 5/1979 | Gorring et al. | 208/89 |
| 4,191,635 | 3/1980 | Quick et al. | 208/89 |
| 4,340,466 | 7/1982 | Inooka | 208/210 |

*Primary Examiner*—Delbert E. Gantz
*Assistant Examiner*—O. Chaudhuri
*Attorney, Agent, or Firm*—James R. Henes; William T. McClain; William H. Magidson

[57] ABSTRACT

Hydrodenitrogenation of high nitrogen content hydrocarbon feeds comprises contacting the feed with hydrogen under hydrodenitrogenation conditions in the presence of a multiple catalyst system comprising an initial catalyst of apparent higher order reaction kinetics and lower rate constant for hydrodenitrogenation followed by at least one subsequent catalyst of apparent lower order reaction kinetics and higher rate constant for hydrodenitrogenation.

30 Claims, 1 Drawing Figure

MULTIPLE CATALYST SYSTEM FOR HYDRODENITROGENATION OF HIGH NITROGEN FEEDS

BACKGROUND OF THE INVENTION

Figure 1:
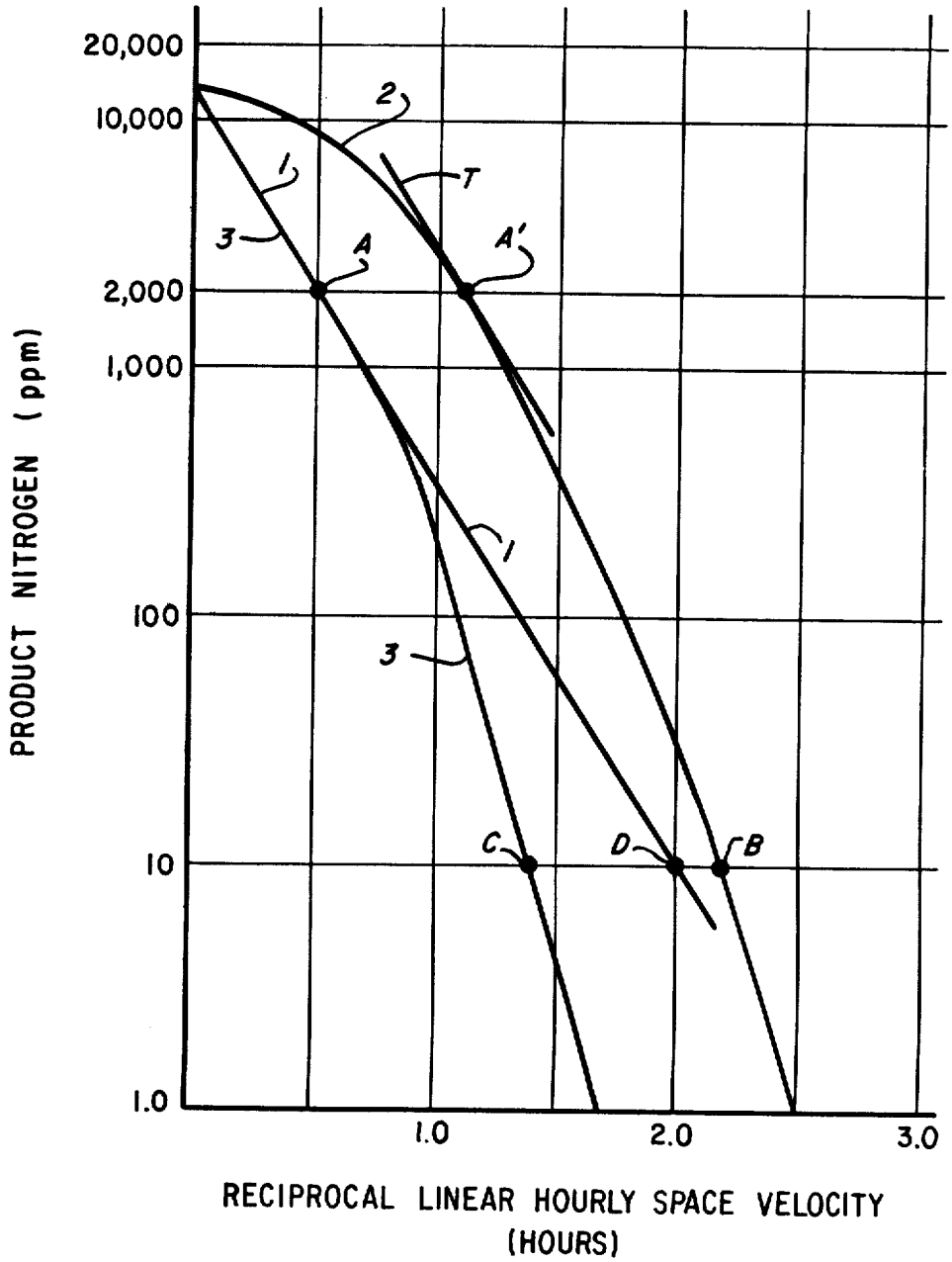

This invention relates to hydrodenitrogenation of high nitrogen content hydrocarbon feeds in the presence of a multiple catalyst system.

Decreasing supplies of high quality petroleum crude oils have focused considerable attention on production and upgrading of lower quality petroleum crude oils as well as synthetic materials. Oil shale shows promise as an abundant as well as reliable source of hydrocarbons that can be converted to products of the type commonly obtained from petroleum hydrocarbons. Unfortunately, typical shale oils contain extremely high levels of nitrogen as well as significant amounts of oxygen as compared to many petroleum crude oils. Accordingly, to facilitate conversion of shale oils to useful products or products suitable for use as feed materials in conventional petroleum refining operations, treatment is required to reduce or remove nitrogen and oxygen.

Of course, nitrogen containing petroleum crude oils also are known and a number of processes for removal of nitrogen from nitrogen-containing feeds obtained from both petroleum and synthetic crude oils have been proposed. Among these are various solvent denitrification processes involving extraction of feeds with acids or polar solvents to remove nitrogen-containing molecules, as well as catalytic processes typically involving contacting a feed material with hydrogen in the presence of hydrodenitrogenation catalysts whereby nitrogen and hydrogen react to form easily removable nitrogen compounds such as ammonia without substantial destruction of hydrocarbon feed components with which the nitrogen was associated.

Typical catalysts employed in catalytic hydrodenitrogenation processes contain a hydrogenating metal component such as an oxide or sulfide of a Group VIB and/or VIII metal deposed on a refractory inorganic oxide support such as alumina. Examples of such catalysts are disclosed in U.S. Pat. No. 3,446,730 (Kerns et al.) and U.S. Pat. No. 3,749,664 (Mickelson).

Recently, workers in our laboratories have attained particularly good results in terms of hydrodenitrogenation of high nitrogen feeds such as whole shale oils and fractions thereof through the use of improved catalytic compositions comprising a chromium component, a molybdenum component and at least one Group VIII metal component deposed on a support component comprising a porous refractory inorganic oxide matrix component and a crystalline molecular sieve zeolite component. Such compositions and use thereof in hydrogen processing are disclosed and claimed in commonly assigned, copending application Ser. No. 200,536 of Tait et al. filed Oct. 24, 1980. Excellent results also have been attained using catalysts containing a similar hydrogenating component deposed on a support comprising silica and alumina according to commonly assigned, copending application Ser. No. 200,544 of Tait et al. filed Oct. 24, 1980, and with catalysts containing a hydrogenating component comprising a chromium component, at least one other Group VIB metal component and at least one Group VIII metal component and a phosphorus component deposed on a porous refractory inorganic oxide support as disclosed and claimed in commonly assigned, copending application Ser. No. 231,757 of Miller filed Feb. 5, 1981.

Although desirable results have been attained according to the above-described proposals, further improvements in hydrodenitrogenation of high nitrogen feeds would be desirable.

It is an object of this invention to provide an improved process for denitrogenation of high nitrogen content feeds. A further object is to provide an improved hydrodenitrogenation process wherein reactor throughputs are increased so that greater production of denitrogenated product is achieved for a given reactor volume. Another object of the invention is to achieve such results by a process which affords substantial savings in catalyst costs as compared to the aforesaid process in which the catalyst is a crystalline molecular sieve zeolite-containing catalyst. Other objects of the invention will be apparent to persons skilled in the art from the following description and the appended claims.

We have now found that the objects of this invention can be attained by hydrodenitrogenation of high nitrogen content feeds in the presence of a multiple catalyst system in which individual catalysts of the system are selected on the basis of reaction kinetics and rate constants to yield improved results in denitrogenation of high nitrogen feeds. While it is well known that the activity of various catalysts for hydrodenitrogenation reactions vary depending on catalytic composition, observed hydrodenitrogenation reaction kinetics of such catalysts in hydrodenitrogenation of hydrocarbon feed materials containing conventional levels of nitrogen are essentially first order following Langmiur-Hinshelwood kinetics given by the following equation:

$$R=K_1[N]/(1+K_2[N])$$

wherein R is the instantaneous hydrodenitrogenation reaction rate, $K_1$ is the hydrodenitrogenation rate constant, [N] is instantaneous nitrogen concentration and $K_2$ is the inhibition constant.

$K_2$ is small for catalysts containing weakly-to-moderately acidic supports, e.g., alumina-supported catalysts. As a result, hydrodenitrogenation kinetics are observed to be first order with respect to nitrogen concentration. On the other hand, $K_2$ unexpectedly has been found to be large for catalysts with more acidic supports, e.g., silica-alumina- or crystalline molecular sieve zeolite-alumina-supported catalysts. Accordingly, such catalysts are observed to exhibit less than first order kinetics, i.e., feed nitrogen exerts an appreciable inhibiting effect on reaction rate. The impact of the inhibition is especially significant at the high nitrogen concentrations typically found in shale oils and fractions thereof.

As observed for $K_2$, the value of the rate constant, $K_1$, has been found to vary with the acid strength of catalyst supports. $K_1$ is determined from appropriate kinetic curves and equals the slope of the tangent to the curve near zero nitrogen concentration. For example, when [N] is near zero, $K_2$ [N] also is very small. Accordingly, the instantaneous reaction rate, R, is essentially $K_1$ [N]. At low nitrogen concentration, $K_1$ can be determined in the usual way for first order reactions by plotting the log of product nitrogen concentration as a function of time and determining the slope. An important finding is that the rate constant, $K_1$, is higher for catalysts having strongly acidic supports.

On the basis of these surprising findings, we have found that by using appropriate combinations of catalysts for hydrodenitrogenation, it is possible to obtain substantially improved hydrodenitrogenation rates as compared to those attained through the use of the individual catalysts. In fact, by appropriate selection of catalysts, hydrodenitrogenation rates up to 150% of those of the individual hydrodenitrogenation catalysts of the multiple catalyst system can be attained. In addition, as compared to the use of single catalyst systems in which the catalyst is a highly active one containing a crystalline molecular sieve zeolite component, appropriate combination of catalysts according to the present invention can yield not only improvements in denitrogenation, but also, savings in catalyst cost by virtue of reducing the amount of zeolite-containing catalyst employed.

In connection with the present invention it should be recognized that the use of multiple catalyst systems in refining operations is known. For example, U.S. Pat. No. 4,165,274 (Kwant) discloses a two-step hydrocracking process in which a tar sands oil distillate in first hydrotreated in the presence of a weakly or moderately acidic catalyst, such as a fluorine- and phosphorus-containing nickel-molybdenum on alumina catalyst, to reduce sulfur, nitrogen and polyaromatics content, after which the hydrotreated product is hydrocracked to a lower boiling product in the presence of a moderately or strongly acidic catalyst such as nickel-tungsten on low-sodium; type-Y molecular sieve. Similar two-step hydrocracking is conducted as part of a process for preparing medicinal oil and light hydrocarbon fractions such as naphtha and kerosene from heavy hydrocarbon oils such as vacuum distillates and deasphalted atmospheric and vacuum distillation residues according to U.S. Pat. No. 4,183,801 (Breuker et al.).

Although the above-described processes involve the use of multiple catalysts which may vary in acidity, the invented process differs in several respect. First, in the two-step hydrocracking process of Kwant and Breuker et al., each of the two steps has a distinct purpose, i.e., hydrotreating to remove contaminants in the first step and hydrocracking in the second step. In contrast, the process of the present invention makes use of a multiple catalyst system in which the predominant reactions throughout the entire system are hydrodenitrogenation. Hydrocracking may, though need not, accompany the denitrogenation. Neither Kwant nor Breuker et al. discloses or suggests a multiple catalyst bed process for hydrodenitrogenation nor do these patents address hydrodenitrogenation of high nitrogen content feeds such as are employed according to the present invention. Further, neither Kwant nor Breuker et al. suggests a process in which catalysts are manipulated on the basis of apparent reaction kinetics and rate constants for a single reaction, i.e., hydrodenitrogenation, to attain substantially improved results in terms of reactor throughputs.

DESCRIPTION OF THE INVENTION

Briefly, the process of this invention is a process for hydrodenitrogenation of high nitrogen feeds which comprises contacting the feed with hydrogen under hydrodenitrogenation conditions in the presence of a multiple catalyst system comprising a first hydrodenitrogenation catalyst that exhibits apparent higher order reaction kinetics but lower rate constant for hydrodenitrogenation, and at least one subsequent hydrodenitrogenation catalyst that exhibits apparent lower order reaction kinetics but higher rate constant for hydrodenitrogenation. For purposes hereof, the terms higher and lower refer to apparent order hydrodenitrogenation reaction kinetics and hydrodenitrogenation rate constant of the aforesaid first and subsequent catalysts in a relative sense with respect to each other. That is, the first catalyst has apparent higher order reaction kinetics but lower rate constant for hydrodenitrogenation than the aforesaid subsequent catalyst. Correspondingly, the subsequent catalyst has apparent lower order reaction kinetics and higher rate constant for hydrodenitrogenation than the first catalyst.

According to a more specific aspect, the invented process comprises a first step in which high nitrogen content hydrocarbon feed such as a whole petroleum or synthetic crude oil, coal or biomass liquid, or a fraction thereof is contacted with hydrogen under hydrodenitrogenation conditions in the presence of hydrodenitrogenation catalyst of low or moderate acidity, and at least one subsequent step in which an effluent from the first step is contacted with hydrogen under hydrodenitrogenation conditions in the presence of hydrodenitrogenation catalyst of moderate or strong acidity which is more acidic than the first step catalyst.

A presently preferred manner of operating in accordance with the present invention is a two-step process. However, it should be understood that processes comprising more than two steps also are contemplated according to the invention. For example, three or more catalysts of apparent decreasing order reaction kinetics and increasing rate constant for hydrodenitrogenation can be combined to form a suitable multiple catalyst system. It also is contemplated to follow the multi-step denitrogenation catalyst system with one or more catalysts designed to promote reactions other than hydrodenitrogenation. For example, subsequent to multiple step hydrodenitrogenation according to the invention, a hydrocracking catalyst can be employed to convert the denitrogenated product of the present invention to lower boiling product.

Relative proportions of catalysts employed in the multiple step denitrogenation process of the invention are not critical from the standpoint of operability. Thus, in the presently preferred two-step process, the first catalyst of apparent higher order kinetics and lower rate constant generally makes up about 10 to about 90% of total catalyst in the denitrogenation system with the balance being made up of the second catalyst of apparent lower order kinetics but higher rate constant. In a multiple catalyst system of three or more catalysts, the initial catalyst of apparent highest order kinetics and lowest rate constant generally makes up about 10 to about 70% of the total hydrodenitrogenation catalyst system, a subsequent catalyst of apparent lowest order kinetics but highest rate constant makes up about 10 to about 40% of the system with the intermediate catalyst or catalysts of the system having apparent intermediate order kinetics and rate constants. For a specific multiple step denitrogenation process, optimum proportions of the individual catalysts for a given feed will vary depending on the number and specific catalysts to be employed, feed nitrogen content and operating conditions, and can be determined from standard kinetic curves of the type illustrated in FIG. 1.

Referring to FIG. 1, there are presented plots of the log of product nitrogen against time (reciprocal linear hourly space velocity) for individual denitrogenation catalysts and a two catalyst system in which the individual catalysts are combined to attain maximum overall reaction rate and reactor throughput. Line 1 represents a catalyst of low or moderate acidity. As can be seen, log of product nitrogen varies in essentially direct proportion to time thus indicating essentially first order kinetics. Line 2 represents a catalyst of higher hydrodenitrogenation rate constant but apparent lower order kinetics as indicated by the nonlinear relation between log of product nitrogen and time.

From lines 1 and 2, it can be observed that until product nitrogen is reduced to about 2,000 ppm (points A and A'), the catalyst represented by line 1 gives superior overall denitrogenation as a function of time, despite its lower rate constant, owing to its apparent higher order kinetics. Referring to line 2, at about 2,000 ppm nitrogen (point A'), the slope of tangent T to line 2 equals the slope of line 1 indicating that at this point the instantaneous reaction rates of catalysts 1 and 2 are essentially the same. At less than about 2,000 ppm nitrogen, catalyst 2 is more effective for denitrogenation. Thus, by appropriate combination of catalysts 1 and 2 according to the invention, denitrogenation proceeds according to line 3. From the initial product nitrogen level to about 2000 ppm nitrogen, catalyst 1 is more efficient and therefore is employed until product nitrogen reaches a level at which catalyst 2 is more efficient, at which point catalyst 2 is employed to reduce product nitrogen to a still lower level.

Catalyst volume varies directly with reciprocal LHSV, and accordingly, optimum proportions of catalyst are determined on the basis of the kinetics curves. Referring again to FIG. 1, reaction rates of catalysts 1 and 2 are essentially the same at points A and A' which corresponds to reciprocal LHSV of about 0.5 for catalyst to 1. This is the volume of catalyst 1 per volume of feed required for optimum denitrogenation in the two catalyst system. For a desired final product nitrogen level, reciprocal LHSV is determined from line 3. This value represents total volume of catalyst per volume of feed in the two catalyst denitrogenation system. For example, if a final product nitrogen level of 10 ppm (point C) is desired, reciprocal LHSV from line 3 is about 1.4. Volume of catalyst 2 per volume of feed is the difference between total volume (1.4) and the volume of catalyst 1 (0.5), that is, 0.9. As can be seen from line 3, use of 0.5 volume of catalyst 1 followed by 0.9 volume of catalyst 2 per volume of feed results in reduction of product nitrogen to 10 ppm (point C) at reciprocal LHSV of about 1.4. In contrast, to reach 10 ppm nitrogen requires reciprocal space velocity of about 2.2 with catalyst 2 (point B) or about 2.0 (point D) with catalyst 1. Accordingly, the two catalyst system of the invention allows reduction to 10 ppm nitrogen at about 57% higher space velocity than operation with catalyst 2 and about 43% higher space velocity than with catalyst 1. Accordingly, by employing sufficient volume of first step catalyst to reduce feed nitrogen content to a point at which instantaneous hydrodenitrogenation rate constant of the second catalyst approximates that of the first catalyst, and employing sufficient volume of second catalyst to attain the desired final product nitrogen level, the catalyst system is optimized and reactor throughput is significantly improved over that of either of the individual catalysts.

Useful catalysts of apparent higher order reaction kinetics and lower rate constant for hydrodenitrogenation are those having supports of low or moderate acidity. Thus, suitable initial catalysts are those comprising a hydrogenating component and a support component of low or moderate acidity. Suitable hydrogenation components are those that comprise metals of Group VIB or VIII or combinations thereof, specific examples of which include chromium, molybdenum, tungsten, cobalt, nickel, iron, platinum, palladium, rhodium, ruthenium, iridium and osmium. Suitable supports of low acidity include non-zeolitic porous refractory inorganic oxides such as alumina, zirconia, magnesia, titania, silica stabilized alumina, and phosphated aluminas. Typically, hydrogenating component content of such catalysts ranges from about 5 to about 40 wt% and support content ranges from about 60 to about 95 wt%.

Preferred catalysts for use in the initial portion of a multiple catalyst bed according to the invention are those in which the support component comprises alumina and the hydrogenating component comprises a combination of nickel and molybdenum; phosphorus-promoted nickel and molybdenum; cobalt, chromium and molybdenum; phosphorus-promoted cobalt, chromium and molybdenum; nickel, chromium and molybdenum; and phosphorus-promoted nickel, chromium and molybdenum. A specific example of a nickel-molybdenum catalyst is reported in U.S. Pat. No. 2,437,533 (Huffman). Phosphorus-promoted nickel-molybdenum catalysts are reported in the Kerns et al. and Mickelson patents cited hereinabove. Cobalt-chromium-molybdenum and nickel-chromium-molybdenum catalysts are disclosed in commonly assigned U.S. Pat. No. 4,224,144 (Hensley et al.). Phosphorus-promoted cobalt-chromium-molybdenum and nickel-chromium-molybdenum catalysts are disclosed and claimed in commonly assigned co-pending application Ser. No. 231,757 of Miller filed Feb. 5, 1981. All of the aforesaid patents and applications are incorporated herein by reference.

Useful catalysts of apparent lower order reaction kinetics and higher rate constant for hydrodenitrogenation are those having supports of moderate or strong acidity. Such catalysts contain hydrogenating components such as are described hereinabove and a silica-containing support such as a silica-alumina, a crystalline molecular sieve zeolite or a dispersion of such zeolite in a non-zeolitic matrix such as alumina or silica-alumina. Examples of useful crystalline molecular sieve zeolites include crystalline aluminosilicate zeolites and crystalline borosilicate zeolites.

Preferred catalysts for use in one or more subsequent portions of a catalyst bed according to this invention are those in which the hydrogenating component is nickel-molybdenum, phosphorus-promoted nickel-molybdenum, cobalt-chromium-molybdenum, phosphorus-promoted cobalt-chromium-molybdenum, nickel-chromium-molybdenum and phosphorus-promoted nickel-chromium-molybdenum, and in which the support component is silica-alumina containing at least about 10 wt% silica, a crystalline aluminosilicate zeolite such as mordenite-, faujasite-, ZSM- or ultrastable Y-type zeolite, or a crystalline borosilicate zeolite of the AMS type. Further details with respect to catalysts containing cobalt or nickel, chromium and molybdenum supported on acidic supports containing silica and alumina are disclosed in commonly assigned co-pending application Ser. No. 200,544 of Tait et al. filed Oct. 24, 1980. Further details with respect to catalysts having similar hydrogenating components supported on a crystalline molecular sieve zeolite component dispersed in alumina are found in commonly assigned co-pending application Ser. No. 200,536 of Tait et al. filed Oct. 24, 1980. Further details with respect to phosphorus-promoted hydrogenating components containing nickel or cobalt, chromium and molybdenum supported on a dispersion of crystalline molecular sieve zeolite in a porous refractory oxide matrix are disclosed in co-pending, commonly assigned application Ser. No. 320,866 of Hensley et al. filed concurrently herewith.

Hydrocarbon feeds employed according to the present invention are those containing substantial levels of nitrogen. Preferred feeds are those containing at least about 0.4 wt. % nitrogen. Below about 0.3 wt. % nitrogen, apparent reaction kinetics for the catalysts typically employed according to the present invention do not differ enough to afford appreciable advantages through the use of the invented multiple step process. Specific examples of preferred high nitrogen feeds include whole shale oils and fractions thereof such as resids, distillates and naphthas. Petroleum crude oils, coal or biomass liquids and tar sands oils suitably high in nitrogen also give good results according to the invention.

Hydrodenitrogenation conditions employed according to the present invention vary somewhat depending upon the choice of feed material. Conditions also can vary in the individual steps of the multiple step process to account for changes in feed composition resulting from passage of the feed through the catalyst system. In general, hydrodenitrogenation conditions include a temperature of about 650 to about 820° F., hydrogen pressure of about 800 to about 2500 psi, LHSV of about 0.2 to about 3 and hydrogen addition rate of about 2000 to about 20000 standard cubic feed per barrel (SCFB). Preferably, temperature is about 680° to about 750° F., hydrogen pressure is about 1200 to about 2200 psi, LHSV is about 0.3 to about 2 and hydrogen addition rate is about 4000 to about 15,000 SCFB.

The invented process can be operated in fixed or expanded bed mode in a single stage or multiple stages as desired. Fixed bed operations are preferred for high nitrogen feeds in view of the better performance thereof resulting from limited backmixing.

The present invention is further described in connection with the following examples, it being understood that the same are for purposes of illustration and not limitation.

EXAMPLES

Hydrogenation testing of individual hydrodenitrogenation catalysts and a multiple catalyst system according to the invention was conducted in an automated processing unit having a vertical, downflow, tubular reactor of about 30" length and ⅜" inner associated with automatic controls for regulation of hydrogen pressure, feed and hydrogen flow and temperature. Catalyst was loaded into a 12" segment in the central portion of the reactor and contacted therein with a gaseous mixture of 8 vol. % $H_2S$ in hydrogen at 300° F. for about 1 hour, at 400° F. for about 1 hour and at 700° F. for about 1 hour. Flow of the $H_2S$/hydrogen mixture was discontinued and the reactor was pressured with hydrogen, feed was pumped to the reactor using a positive displacement pump and the reactor was heated to operating temperature. Samples were taken with the aid of a high pressure separator.

The high nitrogen content hydrocarbon feed material used in all runs was an in situ-generated whole shale oil having the following properties:

| | |
|---|---|
| API gravity (°) | 23.8 |
| Carbon (wt %) | 84.82 |
| Hydrogen (wt %) | 11.83 |
| Nitrogen (wt %) | 1.32 |
| Oxygen (wt %) | 1.40 |
| Sulfur (wt %) | 0.64 |

| Simulated Distillation | |
|---|---|
| IBP (°F.) | 290 |
| IBP-360° F. | 2.0 wt. % |
| 360-650° F. | 42.5 wt. % |
| 650° F.+ | 55.5 wt. % |
| 1000° F.+ | 12.8 wt. % |

Catalysts used in the hydrodenitrogenation tests were as follows:

(A) 1.5 wt.% CoO, 5 wt.% $Cr_2O_3$, 15 wt.% $MoO_3$ and 5.1 wt.% phosphorus component, calculated as $P_2O_5$, supported on alumina.

(B) 1.5 wt.% CoO, 5 wt.% $Cr_2O_3$, 15 wt.% $MoO_3$ and 4.0 wt.% phosphorus component, calculated as $P_2O_5$, supported on a dispersion of 50 wt.% ultrastable Y-type crystalline aluminosilicate zeolite in 50 wt.% alumina.

(C) 1.5 wt.% CoO, 5 wt.% $Cr_2O_3$, 15 wt.% $MoO_3$ and 4.0 wt.% phosphorus component, calculated as $P_2O_5$, supported on alumina.

(D) 1.5 wt.% CoO, 10 wt.% $Cr_2O_3$ and 15 wt.% $MoO_3$ supported on a dispersion of 50 wt.% ultrastable Y-type crystalline aluminosilicate zeolite dispersed in 50 wt.% alumina.

In Example I, control runs 1 and 2 were conducted using 100% of catalysts A and B respectively. Run 3 was conducted using a two catalyst system containing catalyst A in the top 40% of the bed and catalyst B in the bottom 60%. In Example II, control run 4 employed 100% catalyst D while run 5 employed a two catalyst system containing catalyst C in the top 50% of the bed and catalyst D in the bottom 50% of the bed.

Operating conditions and results are reported in Table I.

TABLE I

| EXAMPLE | I | | | II | |
|---|---|---|---|---|---|
| RUN NO. | 1 | 2 | 3 | 4 | 5 |
| CATALYST | 100% A | 100% B | 40% A 60% B | 100% D | 50% C 50% D |
| DAYS ON OIL | 7[1] | 4[2] | 5 | 48 | 46 |
| TEMP (°F.) | 760 | 760 | 760 | 782 | 782 |
| PRESSURE (psi) | 1800 | 1800 | 1800 | 2000 | 2000 |
| LHSV ($hr^{-1}$) | 0.50 | 0.50 | 0.47 | 0.40 | 0.57 |
| PRODUCT NITROGEN (ppm) | 7.5 | 17[2] | 1.8 | 6.0 | 2.0 |

[1]Product nitrogen calculated from kinetic curve.
[2]On day 7, product nitrogen was 24 ppm.

As can be seen from the table, use of the two catalyst system in Example I, run 3 resulted in significantly improved denitrogenation as compared to runs 1 and 2 using the individual catalysts of the system. Overall, denitrogenation in run 3 was 13% greater than in run 1 and 25% greater than in run 2. Similarly, in Example II, use of the two catalyst system in run 5 gave improved denitrogenation as compared to use of a single catalyst in run 4. Overall, denitrogenation in run 5 was 43% greater than in run 4.

We claim:

1. A process for hydrodenitrogenation of high nitrogen content hydrocarbon feeds comprising contacting the feed with hydrogen under hydrodenitrogenation conditions in the presence of a multiple catalyst system comprising a first hydrodenitrogenation catalyst of apparent higher order reaction kinetics and lower rate constant for hydrodenitrogenation and at least one subsequent hydrodenitrogenation catalyst of apparent lower order reaction kinetics and higher rate constant for hydrodenitrogenation, wherein the volume of the first hydrodenitrogenation catalyst in said system is effective to reduce the nitrogen content of the feed to a level at which the instantaneous hydrodenitrogenation reaction rate of at least one aforesaid subsequent hydrodenitrogenation catalyst approximates the instantaneous hydrodenitrogenation reaction rate of the first hydrodenitrogenation catalyst, the remainder of catalyst volume in said system comprising said subsequent hydrodenitrogenation catalyst.

2. The process of claim 1 wherein the high nitrogen hydrocarbon feed contains at least about 0.4 wt% nitrogen.

3. The process of claim 1 wherein hydrodenitrogenation conditions include a temperature of about 650° to about 820° F., hydrogen pressure of about 800 to about 2500 psi, LHSV of about 0.2 to about 3 and hydrogen addition rate of about 2000 to about 20,000 SCFB.

4. The process of claim 1 wherein the first hydrodenitrogenation catalyst of apparent higher order reaction kinetics and lower rate constant for hydrodenitrogenation comprises a weakly or moderately acidic support.

5. The process of claim 4 wherein the first hydrodenitrogenation catalyst comprises a hydrogenating component comprising at least one metal of Group VIB or VIII or both deposed on a nonzeolitic porous refractory inorganic oxide support of low or moderate acidity.

6. The process of claim 5 wherein the hydrogenating component of the first hydrodenitrogenation catalyst comprises nickel-molybdenum, phosphorus-promoted nickel-molybdenum, cobalt-chromium-molybdenum, phosphorus-promoted cobalt-chromium-molybdenum, nickel-chromium-molybdenum or phosphorus-promoted nickel-chromium-molybdenum and the support component of the first hydrodenitrogenation catalyst comprises alumina.

7. The process of claim 1 wherein the subsequent hydrodenitrogenation catalyst of apparent lower order reaction kinetics and higher rate constant for hydrodenitrogenation comprises a moderately or strongly acidic support of greater acidity than that of the first hydrodenitrogenation catalyst.

8. The process of claim 7 wherein the subsequent hydrodenitrogenation catalyst comprises a hydrogenating component comprising at least one metal of Group VIB or VIII or both deposed on a zeolitic or nonzeolitic support comprising silica.

9. The process of claim 8 wherein the hydrogenating component of the subsequent hydrodenitrogenation catalyst comprises nickel-molybdenum, phosphorus-promoted nickel-molybdenum, cobalt-chromium-molybdenum, phosphorus-promoted cobalt-chromium-molybdenum, nickel-chromium-molybdenum or phosphorus-promoted nickel-chromium-molybdenum and the support of the subsequent hydrodenitrogenation catalyst comprises silica-alumina, a crystalline molecular sieve zeolite, a dispersion of said zeolite in a nonzeolitic porous refractory inorganic oxide or a combination thereof.

10. The process of claim 6 wherein the hydrogenating component of the first hydrodenitrogenation catalyst comprises phosphorus-promoted nickel-molybdenum.

11. The process of claim 9 wherein the hydrogenating component of the subsequent hydrodenitrogenation catalyst comprises cobalt-chromium-molybdenum and the support of the subsequent hydrodenitrogenation catalyst comprises a crystalline molecular sieve zeolite.

12. The process of claim 1 wherein the multiple catalyst system is a two catalyst system and the volume of the subsequent hydrodenitrogenation catalyst is sufficient to reduce product nitrogen level to the desired level.

13. A process for hydrodenitrogenation, with a volume of catalyst, of high nitrogen hydrocarbon feeds containing at least about 0.4 wt% nitrogen comprising contacting the feed with hydrogen under hydrodenitrogenation conditions in a first step in the presence of a catalyst having a weakly or moderately acidic support, and contacting an effluent from such first step with hydrogen under hydrodenitrogenation conditions in at least one subsequent step in the presence of a hydrodenitrogenation catalyst having a moderately or strongly acidic support of greater acidity than that of the first catalyst, wherein the volume of catalyst employed in the first step is effective to reduce nitrogen content of the feed to a level at which the instantaneous hydrodenitrogenation rate constant of the subsequent step catalyst approximates the instantaneous hydrodenitrogenation rate constant of the first step catalyst, the remaining volume of catalyst comprising said subsequent step catalyst.

14. The process of claim 12 wherein hydrodenitrogenation conditions include a temperature of about 650° to about 820° F., hydrogen pressure of about 800 to about 2500 psi, LHSV of about 0.2 to about 3 and hydrogen rate of about 2000 to about 20,000 SCFB.

15. The process of claim 14 wherein the first step catalyst comprises a hydrogenating component comprising at least one metal of Group VIB or VIII or both deposed on a nonzeolitic porous refractory inorganic oxide support of low or moderate acidity.

16. The process of claim 15 wherein the hydrogenating component of the first step catalyst comprises at least one metal selected from the group consisting of nickel, cobalt, molybdenum and chromium and the support component of the first step catalyst comprises alumina.

17. The process of claim 16 wherein the hydrogenating component of the first step catalyst comprises a phosphorus component in addition to said metal.

18. The process of claim 13 wherein the subsequent step catalyst comprises a hydrogenating component comprising at least one metal of Group VIB or VIII or both deposed on a nonzeolitic or zeolitic support comprising silica.

19. The process of claim 18 wherein the hydrogenating component of the subsequent step catalyst comprises at least one metal selected from the group consisting of nickel, cobalt, molybdenum and chromium and the support component of the subsequent step catalyst comprises silica-alumina, a crystalline molecular sieve zeolite, a dispersion of said zeolite in a nonzeolitic porous refractory inorganic oxide or a combination thereof.

20. The process of claim 19 wherein the hydrogenating component of the subsequent step catalyst contains a phosphorus component in addition to said metal.

21. The process of claim 15 wherein the hydrogenating component of the first step catalyst comprises nickel-molybdenum, phosphorus-promoted nickel-molybdenum, cobalt-chromium-molybdenum, phosphorus-promoted cobalt-chromium-molybdenum, nickel-chromium-molybdenum or phosphorus-promoted nickel-chromium-molybdenum and the support component of the first step catalyst comprises alumina.

22. The process of claim 21 wherein the hydrogenating component of the first step catalyst comprises phosphorus-promoted nickel-molybdenum.

23. The process of claim 18 wherein the hydrogenating component of the subsequent step catalyst comprises nickel-molybdenum, phosphorus-promoted nickel-molybdenum, cobalt-chromium-molybdenum, phosphorus-promoted cobalt-chromium-molybdenum, nickel-chromium-molybdenum or phosphorus-promoted nickel-chromium-molybdenum and the support comprises silica-alumina, a crystalline molecular sieve zeolite, a dispersion of said zeolite in a nonzeolitic porous refractory inorganic oxide or a combination thereof.

24. The process of claim 23 wherein the hydrogenating component of the subsequent step catalyst comprises cobalt-chromium-molybdenum and the support of the subsequent step catalyst comprises a crystalline molecular sieve zeolite.

25. A process for hydrodenitrogenation with a volume of catalyst, of high nitrogen content hydrocarbon feeds containing at least about 0.4 wt% nitrogen comprising contacting the feed with hydrogen under hydrodenitrogenation conditions in a first step in the presence of a catalyst comprising a hydrogenating component comprising at least one metal of Group VIB or VIII or both deposed on a nonzeolitic support comprising alumina or silica-alumina, and contacting an effluent from said first step with hydrogen under hydrodenitrogenation conditions in at least one subsequent step with a catalyst comprising a hydrogenating component comprising at least one metal of Group VIB or VIII or both deposed on a support of greater acidity than that of the first step catalyst comprising silica-alumina, a crystalline molecular sieve zeolite, a dispersion of said zeolite in a nonzeolitic porous refractory inorganic oxide or a combination thereof, wherein the volume of the first step catalyst is effective to reduce nitrogen content of the feed to a level at which the instantaneous hydrodenitrogenation reaction rate of the subsequent step catalyst approximates the instantaneous hydrodenitrogenation reaction rate of the first step catalyst, the remainder of catalyst volume comprising said subsequent step catalyst.

26. The process of claim 25 wherein the hydrogenating component of said first or subsequent step catalyst or both comprises a phosphorus component in addition to said metal or metals of Group VIB or VIII or both.

27. The process of claim 25 wherein the hydrogenating component of the first step catalyst comprises nickel-molybdenum, phosphorus-promoted nickel-molybdenum, cobalt-chromium-molybdenum, phosphorus-promoted cobalt-chromium-molybdenum, nickel-chromium-molybdenum or phosphorus-promoted nickel-chromium-molybdenum and the support component of the first step catalyst comprises alumina.

28. The process of claim 27 wherein the hydrogenating component of the first step catalyst comprises phosphorus-promoted nickel-molybdenum.

29. The process of claim 8 wherein the hydrogenating component of the subsequent step catalyst comprises nickel-molybdenum, phosphorus-promoted nickel-molybdenum, cobalt,-chromium-molybdenum, phosphorus-promoted cobalt-chromium-molybdenum, nickel-chromium-molybdenum or phosphorus-promoted nickel-chromium-molybdenum and the support of the subsequent step catalyst comprises silica-alumina, a crystalline molecular sieve zeolite, a dispersion of said zeolite in a nonzeolitic porous refractory inorganic oxide or a combination thereof.

30. The process of claim 29 wherein the hydrogenating component of the subsequent step catalyst comprises cobalt-chromium-molybdenum and the support of the subsequent step catalyst comprises a crystalline molecular sieve zeolite.

* * * * *